United States Patent [19]

Sheehan et al.

[11] Patent Number: 4,861,279

[45] Date of Patent: Aug. 29, 1989

[54] ELECTRICAL APPARATUS TO BE DIRECTLY COUPLED TO SHEATHED CABLE AND TO WALL STRUCTURES

[75] Inventors: Robert K. Sheehan, Cincinnati, Ohio; Paul R. Smester, Mt. Sinai, N.Y.

[73] Assignee: Corecon Corporation, Cincinnati, Ohio

[21] Appl. No.: 113,541

[22] Filed: Oct. 26, 1987

[51] Int. Cl.[4] ..... H01R 4/24

[52] U.S. Cl. ..... 439/412; 439/535; 439/538; 439/567; 29/857

[58] Field of Search ..... 439/389–419, 439/425, 426, 431, 432, 443, 535, 536, 538, 539, 552, 553, 555, 557, 567, 562; 220/3.2, 3.3, 3.4, 3.5, 3.6, 3.7, 3.8, 3.9; 174/48, 53, 58, 66; 29/857, 861

[56] References Cited

U.S. PATENT DOCUMENTS

| | | | |
|---|---|---|---|
| 1,290,153 | 1/1919 | Fitzpatrick | 339/98 |
| 1,500,641 | 7/1924 | Sabourin | 339/97 |
| 2,720,635 | 10/1985 | Odegaard | 439/418 |
| 2,802,083 | 8/1957 | Lapeyre | 439/409 |
| 2,873,435 | 2/1959 | Hubbell | 339/97 |
| 2,934,737 | 4/1960 | Gibson | 339/97 |
| 2,952,004 | 9/1960 | Hubbell et al. | 339/97 |
| 3,163,482 | 12/1964 | Hubbell et al. | 339/97 |
| 3,233,206 | 2/1966 | Fiala | 339/98 |
| 3,320,385 | 5/1967 | Sherwood | 200/129 |
| 3,710,305 | 1/1973 | Clark | 339/97 R |
| 3,789,347 | 1/1974 | Cooper, Jr. | 339/97 R |
| 3,793,611 | 2/1974 | Johansson et al. | 339/98 |
| 3,835,444 | 9/1974 | Plana et al. | 339/98 |
| 3,935,637 | 2/1976 | Bunnell | 174/48 |
| 4,003,128 | 1/1977 | Dochterman | 29/596 |
| 4,037,905 | 7/1977 | Lucas | 339/98 |
| 4,063,660 | 12/1977 | Ware | 220/3.6 |
| 4,379,605 | 4/1983 | Hoffman | 339/14 R |
| 4,451,104 | 5/1984 | Hodgson et al. | 339/99 R |
| 4,500,746 | 2/1985 | Meehan | 174/48 |
| 4,541,036 | 9/1985 | Landries et al. | 220/3.6 |
| 4,547,033 | 10/1985 | White et al. | 339/97 R |
| 4,552,428 | 11/1985 | Liu | 339/97 R |
| 4,669,804 | 6/1987 | Munroe | 439/535 |
| 4,673,235 | 6/1987 | Conley | 220/3.6 |

OTHER PUBLICATIONS

Slater "SCD" Installation Instructions, 2004–0364–00.

*Primary Examiner*—David Pirlot

*Attorney, Agent, or Firm*—Wood, Herron & Evans

[57] ABSTRACT

The present invention provides electrical apparatus by which to couple wires of a sheathed cable to the conductors of the apparatus and/or to the wires of another sheathed cable without separately cutting the cable(s), removing the sheathing and/or stripping insulation from the wires of the cable whereby to substantially reduce labor and material costs. The present invention further provides such apparatus which may be directly secured to a structural wall thereby eliminating the use of junction boxes.

34 Claims, 3 Drawing Sheets

ELECTRICAL APPARATUS TO BE DIRECTLY COUPLED TO SHEATHED CABLE AND TO WALL STRUCTURES

BACKGROUND OF THE INVENTION

I. Field of the Invention

The present invention relates generally to electrical apparatus adapted to be directly coupled to non-metallic sheathed cable without the necessity of removing the sheathing and/or insulation from the wires of the cable. The present invention relates more specifically to electrical switch and/or plug receptacle apparatus which are adapted to be so coupled to the sheathed cable and which are further adapted to be secured to a wall or like structure without the necessity of a junction box or the like.

II. Description of the Prior Art

In construction of buildings such as homes, offices and the like, it is necessary to provide electrical plug receptacles (also referred to as outlets) and electrical switches (to control lights, for example) along the walls of such buildings. Conventionally, to provide electricity to the plug receptacles and/or switches, metal or plastic junction box units are mounted at various locations within the walls of the building. Cables comprised of three or more wires are then strung within the walls and between various junction boxes such that looped portions and/or one or more terminal ends of cables are positioned within each junction box. The cable is then coupled at one end to a source of supply such as at a fuse or breaker box and at the other end (or ends) to the plug receptacles, switches, lights, etc.

Typically, a non-metallic sheathed cable includes three wires. One of the wires is referred to as a hot wire and is coated with a black plastic insulation. A second wire is referred to as a neutral wire and is coated with a white plastic insulation. Finally, the third wire is referred to as a ground wire and it is not coated with insulation. The ground wire is, however, usually surrounded by paper and the hot and neutral wires are disposed on opposite sides of the ground wire and parallel thereto. In this manner, a flat cable is formed which has a width greater than its height in cross-section. The three side-by-side wires (including any insulation and paper) are then encapsulated in a plastic non-conducting sheath. Thus, to couple the cable to the power source and the apparatus (e.g., plug receptacle or switch), access must be had to the individual wires within the cables in order to connect the individual wires to the appropriate junctions at the source and at the electrical plug receptacle and/or switch apparatus.

The manner in which the wires are connected to the plug receptacle and/or switch device typically requires substantial expenditure of time and labor to accomplish. For example, it is known to provide screws about which individual wires of the cable may be received and then secured to threaded conductors attached to the housing or body of the plug receptacle or switch apparatus. These conductors are then coupled electrically to the respective plug receptacle contacts or switch poles within the housing of the apparatus.

To make the typical electrical interconnection just described, an electrician must typically make a cut in the looped portion of the cable which was strung through the junction box. This cut is usually made to sever the cable into two portions, whereby to have two terminal ends of the cable available in the junction box.

Whether a loop is cut, or a terminal end of a cable is previously available at the junction box, the individual wires cannot be readily accessed until the electrician removes a portion of the sheathing material from each terminal portion of the cable. During this operation, not only is time required, the electrician must be careful not to nick any of the insulation covering either of the hot or neutral wires. Thereafter, the electrician must strip or remove some of the insulation from those wires which are to be coupled to the plug receptacle and/or switch device. Further, if the terminal end of one wire is to be coupled to the terminal end of another wire so as to complete a circuit, some of the insulation of those wires must similarly be removed and the exposed portions of those wires held together by devices referred to as a wire nuts or the like. With specific reference to a switch apparatus, for example, the neutral and ground wires of one cable would typically be electrically joined with the neutral and ground wires, respectively, of another cable and held together with wire nuts, whereas the hot wires would be connected to respective junctions of the switch so as to couple each hot wire to a respective pole of the switch.

Once the selected wires are connected to the junctions of the plug receptacle or switch apparatus, and the various wires joined together with wire nuts as before described, all of the wires, the wire nuts, and the housing of the plug receptacle or switch apparatus must be placed within the junction box. Thereafter, the plug receptacle or switch apparatus is usually secured to the junction box by a pair of screws which are threadably received in threaded lugs extending from the junction box walls. A cover plate may then be placed over the front of the plug receptacle or switch apparatus and secured thereto by one or more screws, as is conventional. The junction box is further necessary for safety to insure that someone or something does not accidentally come into contact with the otherwise exposed junctions on the plug receptacle or switch apparatus and/or any wire portion which may otherwise be left or become exposed.

All of these foregoing steps necessarily entail much time on the part of highly-paid electricians, thus making the labor costs associated with wiring a building structure very expensive. Similarly, material costs can become quite large due to the necessity of providing junction boxes in association with each plug receptacle and/or switch apparatus, as well as the various wire nuts and the like which are utilized to join certain of the wires together within the junction boxes. Further, with existing structures, it is often necessary to open up a large access area in the wall in order to install a new or additional junction box, such as where an outlet is to be added. Subsequently, the wall must be patched around the periphery of the new junction box. Such procedures can be very time consuming and costly and may discourage addition of further electrical plug receptacles or switches to existing structures.

Devices have been proposed to eliminate certain of the above-mentioned time-consuming steps, such as providing a plug receptacle and/or switch apparatus with insulation piercing structures by which individual wires of the sheath cable may be coupled to the device without the step of removing the insulation therefrom. Devices of this type are shown by way of example in U.S. Pat. Nos. 4,500,746; 4,379,605; 3,710,305; 3,163,482; 2,934,737; 2,952,004; and 2,873,435. Specifically, the terminal end of an insulated wire would be placed within the structure and the apparatus thereafter manipulated to cause a conductive knife or edge to pierce through the insulation and make electrical contact with the wire within. The conductive knife or edge is electrically coupled to a plug receptacle contact or switch pole within the housing of the apparatus whereby the wire is then electrically connected to the contact or pole. While this type of apparatus may save the time necessary for the electrician to strip the insulation from the wire, it does not save the time necessary for the electrician to cut away the sheathing nor does it eliminate the need for caution to avoid damage to the insulation and/or wires within the cable when removing the sheathing.

With the foregoing time-saving devices, it is still also necessary for the electrician to strip the insulation and join together the exposed terminal ends of those wires which must be separately joined together to form a complete circuit. Here, too, apparatus has previously been devised by which the terminal ends of wires may be coupled together without stripping the insulation, such as shown by way of example in U.S. Pat. Nos. 4,451,104 and 1,290,153. Such apparatus might eliminate one of the steps mentioned above, but suffer from the same drawbacks of not eliminating certain time-consuming steps such as removing the sheath, nor do they render unnecessary the precautions necessary as described above. Further, such apparatus still require the expenditure of material costs. That is, some separate apparatus is still required to join the wires together. In any event, applicants are not aware that such insulation piercing devices have been used in connection with the large gauge of wire in the sheathed cables commonly encountered in building structures. It is further a possibility that such devices have not been employed in wiring plug receptacle and/or switch apparatus because they may have to be much larger than currently-used wire nuts in order to accommodate the gauge of the wires involved. There is only limited space within the junction box to place all of the wires and related coupling structures, as well as the housing of the plug receptacle or switch apparatus. Hence, the possibility of requiring large size for the insulation piercing coupling devices would make them undesirable and, even if used, such devices would not eliminate the time expenditure necessary to actually join the wires.

Finally, it has been known to utilize insulation piercing techniques to couple each wire of a two wire cable to the respective conductors of an electrical lamp or the like, such as shown in U.S. Pat. No. 1,500,641. The cable shown therein comprises only a pair of wires which are surrounded by the same insulation. Further, the device of that patent is not disclosed to accommodate a cable wherein the wires are separately insulated. Moreover, it does not appear possible with that device to accommodate a three wire sheathed cable of the type which is commonly encountered in wiring utilized for building structures. Indeed, there is no provision in that device for electrically coupling to more than two wires.

The present invention, therefore, has as an object to provide an electrical apparatus which can be coupled to a sheathed cable having three or more wires therein without the necessity of removing the sheathing and/or insulation of the individual wires within the sheathing.

A further object of the present invention is to provide such an electrical apparatus in which one or more wires in one cable may be electrically coupled to one or more wires in another sheathed cable without the necessity of cutting either of the cables.

An even further object of the present invention is to provide such an electrical apparatus in which one or more wires of one cable may be coupled to one or more wires in another cable without the necessity of removing sheathing and/or insulation from either of the cables.

A yet further object of the present invention is to provide such an electrical apparatus in which selected wires of a cable may be electrically coupled to the appropriate contacts or poles of a plug receptacle or switch while simultaneously electrically coupling those selected wires to selected wires of another cable.

A still further object of the present invention is to provide such an electrical apparatus in which selected wires of a cable may be electrically coupled to the appropriate contacts or poles of a plug receptacle or switch while simultaneously electrically coupling those selected wires to selected wires of another cable without the necessity to remove the sheathing and/or insulation of the individual wires within the sheathing of either of the cables.

A still further object of the present invention is to provide such an electrical apparatus wherein the wires of the cables are inaccessible once the cable is coupled to the apparatus for safety purposes.

An even further object of the present invention is to provide such an electrical apparatus of the aforementioned type which can be mounted to a wall or the like of a building structure without the necessity to utilize junction boxes for the wiring or to hold the apparatus.

A yet further object of the present invention is to provide an electrical switch apparatus which can be coupled to respective and electrically isolated portions of a selected wire of a sheathed cable without the necessity for separately cutting the cable and/or wire and without the necessity of removing sheathing and/or insulation from the cable or wires thereof.

A further object of the present invention is to provide apparatus of the aforementioned type which is relatively simple and straightforward in use and has few moving parts associated therewith.

SUMMARY OF THE INVENTION

To achieve the foregoing objects, and in accordance with the purposes of the invention as embodied and broadly described herein, an electrical apparatus is provided which comprises a non-conductive housing in which first and second electrical conductors are placed and which are in respective electrical communication with respective electrically conducting piercing tangs which extend from the housing. The apparatus further includes a channel to longitudinally receive a portion of a sheathed cable and to position the cable such that the wires to be coupled to the conductors within the housing are in overlying relationship with respective electrically conducting piercing tangs. A clamp is provided for moving the cable portion toward the tangs so as to drive the tangs through the cable sheathing and any insulation surrounding the respective wires such that each electrically conducting piercing tang is electrically connected to a selected wire portion of the cable. There is thus provided a simple-to-use electrical apparatus which with relatively few moving parts can be coupled to a sheathed cable (i.e., having three or more wires) without removing the sheathing or any insulation from the cable, thereby reducing labor and reducing the possibility of damaging a wire of the cable.

To interconnect wires of two cables, the above apparatus is provided with a second set of electrically conducting piercing tangs extending from the housing and also coupled to the conductors within the housing. The apparatus is also further provided a second channel to longitudinally receive a portion of a second sheathed cable and to position the second cable such that the wires are in overlying relationship with respective ones of the second set of electrically conducting piercing tangs. The clamp is adapted to move both the first and second cable portions toward a respective set of tangs so as to drive the tangs of each set through the cable sheathing and any insulation surrounding the respective wires of a respective cable such that the respective wires of one cable are in electrical communication with the respective wires of the other through the conductors within the housing. There is thus provided an electrical apparatus by which one or more wires of the cables may be electrically coupled to one or more wires of another cable without cutting the cables and without removing the sheathing and/or any insulation from either of the cables.

The conductors within the housing of the apparatus of the present invention may be coupled to the respective contacts of a plug receptacle or poles of a switch. Thus, when two cables are secured to the electrical apparatus of the present invention, the cables are simultaneously connected to provide the desired electrical switch or plug receptacle function and also to electrically join the wires of two cables. This duality of purpose is accomplished simultaneously thereby eliminating the need to remove sheathing and/or insulation with its attendant benefits as well as further reducing the amount of labor and materials previously necessary.

With respect to the plug receptacle apparatus, each electrical conductor is connected to a respective plug contact and the tangs are offset within the channel so as to be in overlying relationship with a different wire of the cable. With respect to the switch apparatus, each conductor within the housing is connected to one pole of a switch and the housing is further provided with a cutting blade positioned between the piercing tangs such that as the cable is driven toward the piercing tangs, the knife edge slices through one edge of the sheathing and one of the wires within the cable so as to electrically cut the wire into two respective wire portions. Further, the tangs are aligned in the channel so that as the cable is pushed toward the tangs, one tang will contact one of the wire portions and the other will contact the other wire portion such that the poles of the switch are coupled to each of the wire portions. Thus, when the switch is in the off or open position, the two wire portions will be electrically separated, whereas when the switch is in the on or closed position, the two wire portions will be in electrical communication. Thus, there is provided an electrical switch apparatus which can be coupled to respective and electrically isolated portions of a selected wire of a sheathed cable without the electrician having to cut the cable or wires and/or remove sheathing or insulation.

The present invention further provides mechanism whereby the apparatus may be directly secured to a wall or like structure, thereby completely eliminating the cost and labor associated with the junction box as before described. The structure contemplated by the present invention to accomplish same includes a pair of spaced wall-gripping tabs extending away from the housing, and with mechanism to draw the two tabs toward one another once a portion of a wall is placed therebetween so as to grip the wall securely.

In order to provide added safety, the channels are provided with removable end walls so that selective portions of the cable may be placed in the channel such as where a cable terminates at the electrical apparatus. By removing an end wall at only one end of the channel, a terminal portion of the cable may be placed in the channel such that the other end is not accessible exteriorly of the housing. On the other hand, if a portion of a looped cable is to be coupled to the apparatus, both end walls may be removed and the portion of the cable fitted in the channel such that the cable extends from both ends thereof. By provision of the foregoing, there is thus provided an electrical apparatus which can be electrically coupled to a sheathed cable such that no wire thereof will be exposed from the cable once the cable or cables are coupled to the apparatus. Thus, the need to provide a junction box wherein wire nuts and the like would be received and protection would be provided against someone or something making electrical contact with the junctions of the device or exposed wires is no longer necessary.

By virtue of the foregoing, the various objects of the invention may be accomplished and the advantages thereof obtained.

BRIEF DESCRIPTION OF THE DRAWINGS

The accompanying drawings, which are incorporated in and constitute a part of this specification, illustrate preferred embodiments of the invention and, together with a general description of the invention given above, and the detailed description of the preferred embodiments given below, serve to explain the principles of the invention.

The above general descriptions of the following detailed description are merely illustrative of the generic invention, and additional modes, advantages, and particulars of this invention will be readily suggested to those skilled in the art without departing from the spirit or scope of the invention.

DESCRIPTION OF THE PREFERRED EMBODIMENTS

Reference will now be made in detail to the present preferred embodiments of the invention as illustrated in the accompanying drawings.

Figure 1:
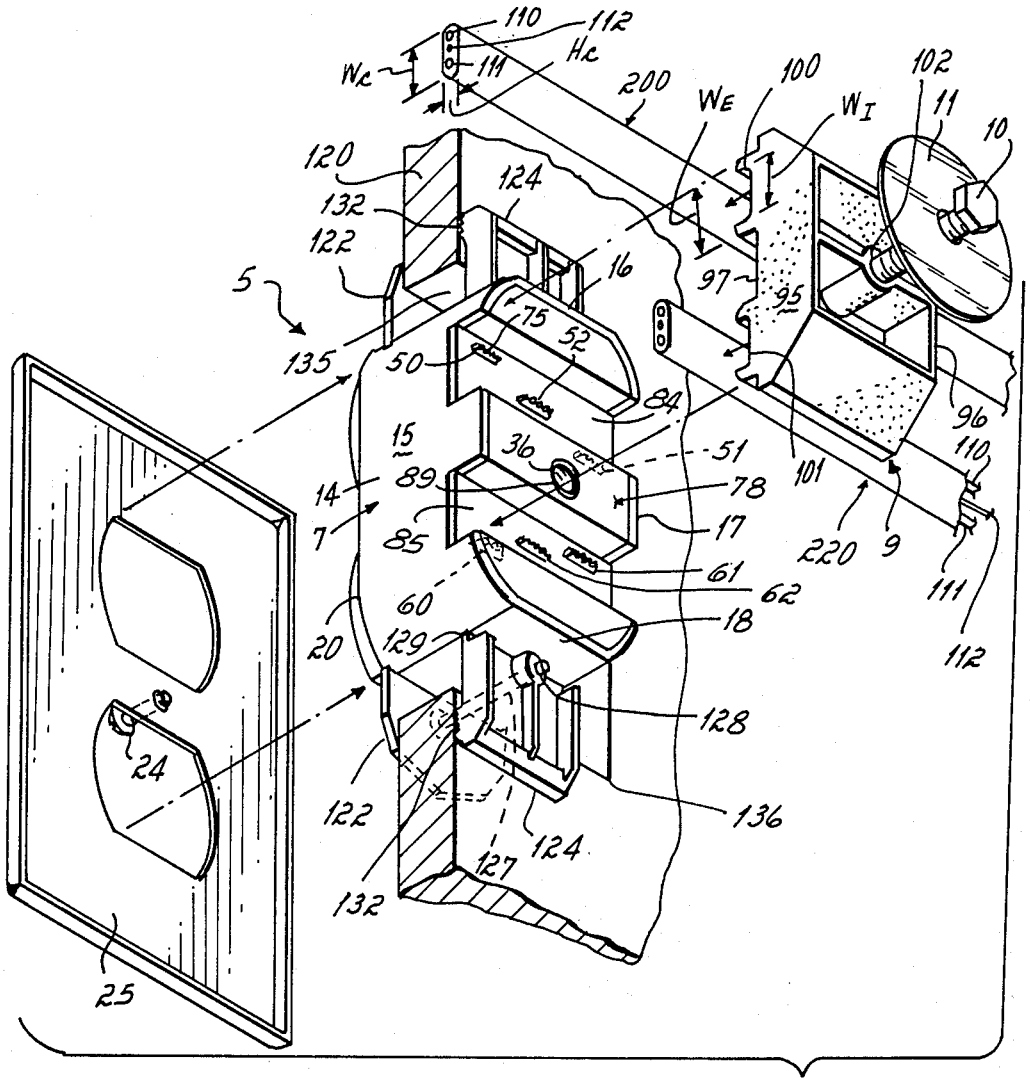
FIG. 1 is a perspective, partially exploded view of an electrical plug receptacle apparatus shown mounted to a portion of a structural wall, all according to the principles of the present invention.
Figure 2:
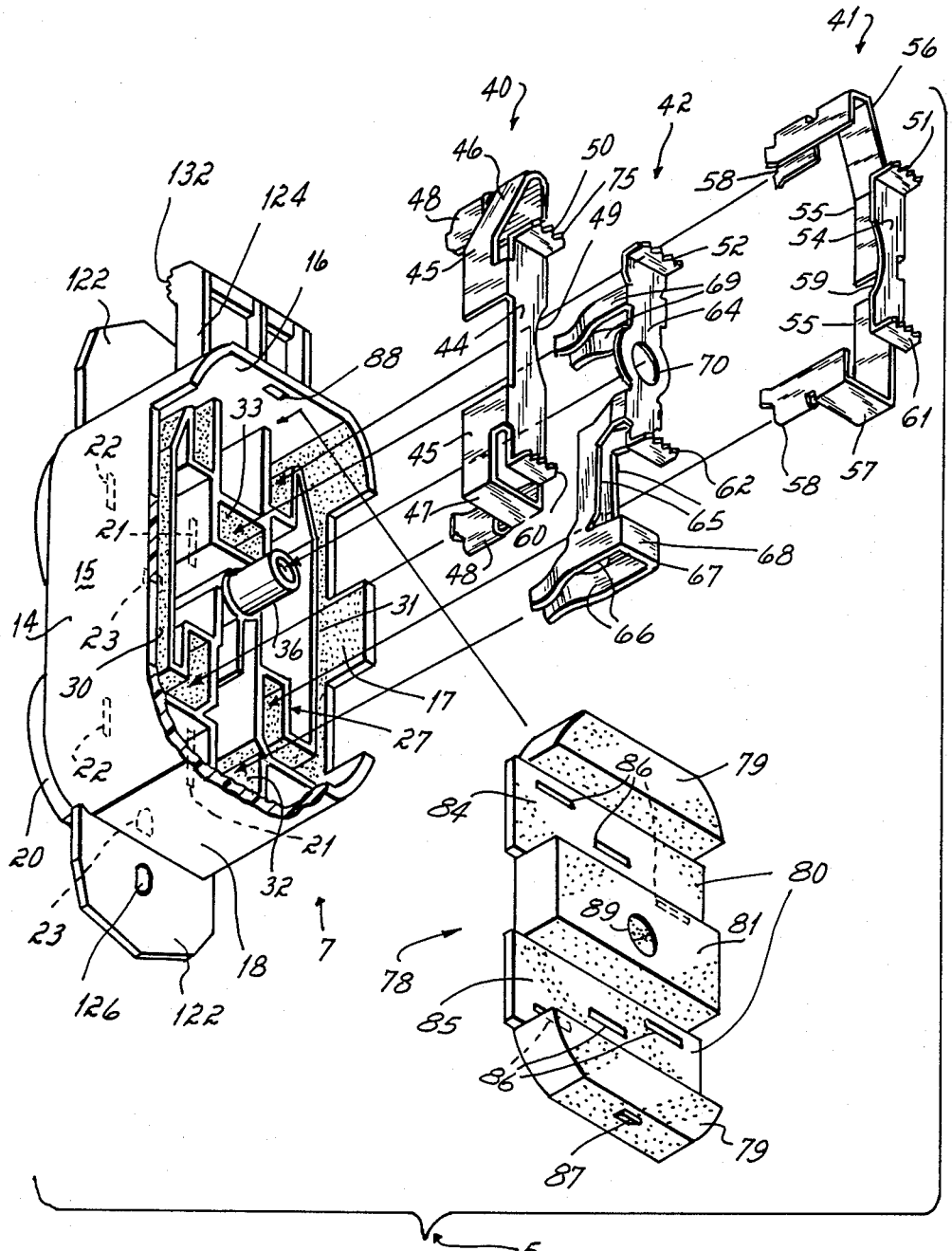
FIG. 2 is an exploded view of the plug body and its contents of the electrical plug receptacle apparatus of FIG. 1.

With reference to FIGS. 1 and 2, there is shown an electrical plug receptacle apparatus 5 according to the teachings of the present invention. Plug receptacle apparatus 5 is comprised of a housing having a plug body 7 and its contents (see FIG. 2) and a clamp 9. A bolt 10 and a washer 11 are provided by which to secure clamp 9 to the back of body 7.

Plug body 7, which may be seen in exploded detail in FIG. 2, is comprised of integral plastic housing 14 having four contiguous side walls 15, 16, 17 and 18 and an interconnecting front wall 20. Front wall 20 is comprised of a plurality of rectangular slots 21, 22 and circular slots 23 (shown in dotted line) which are positioned to provide a duplex arrangement as is well known for receiving the male tines or power prongs and male ground lug of a grounded plug (all not shown). Front wall 20 is further provided with a threaded bore (not shown) in the center thereof to receive a screw 24 by which a cover plate 25 is held to plug receptacle apparatus 5 in conventional fashion.

Housing 14 is accessible through its open back as seen in FIG. 2 and has contained between side walls 15–18, a plurality of integral walls 27 to define a plurality of channels 30–33. Channel 30 is defined between left side wall 15 and a wall 27, and is configured to receive a similarly shaped conductor 40 therein such that respective ends of conductor 40 are in communication with and situated rearwardly of rectangular slots 21 of front face 20. Channel 31 is defined between right side wall 17 and another of walls 27 and is configured to receive a similarly shaped conductor 41 therein such that respective ends of conductor 41 are in communication with and situated rearwardly of rectangular slots 22 of front face 20. Channel 32 is defined between bottom side wall 18 and walls 27 while second channel 33 is defined between top side wall 16 and others of walls 27. Channels 32, 33 are configured to receive respective end portions of conductor 42 such that each end portion of conductor 42 is in communication with and situated rearwardly of a selected one of circular slots 23 of front wall 20. Extending rearwardly from housing 14 is a threaded tube 36 into which the threaded shank of bolt 10 is to be received to draw clamp 9 into engagement with plug body 7 as will be described hereafter.

Conductors 40–42 are each integral metal strips or bands folded or formed as shown in FIG. 2. Specifically, conductor 40 includes a flat top wall 44 adapted to rest upon the tops of walls 27 when conductor 40 is received in channel 30. Extending from wall 44 in a first direction are upper and lower L-shaped legs 45. Legs 45 extend into arcuate strips 46, 47 which are configured to match the configuration of channel 30 so as to hold conductor 40 snugly therein. Strips 46, 47 terminate in similarly-formed U-shaped female contacts 48. Each contact 48 is adapted to receive a male tine or power prong of an electrical plug (not shown) when it is inserted through a slot 21 in front wall 20 so as to make an electrical and mechanical connection between conductor 40 and the plug prong (not shown). Top wall 44 of conductor 40 is notched as at 49 to provide clearance from threaded tube 36. Finally, extending from opposed ends of wall 44 and in a direction opposite that of legs 45 are a pair of electrically conductive insulation piercing tangs 50, 60.

Conductor 41 is similar to conductor 40 and includes a flat top wall 54 adapted to rest upon the tops of walls 27 when conductor 41 is received in channel 31. Likewise, extending in a first direction from wall 54 are upper and lower L-shaped legs 55 each of which extends into a respective arcuate strip 56, 57 configured to match the configuration of channel 31 so as to hold conductor 41 snugly therein. Strips 56, 57 terminate in similarly-formed U-shaped female contacts 58 adapted to receive a male tine or power prong of an electrical plug (not shown) inserted through a slot 22 in front wall 20 so as to make an electrical and mechanical connection between conductor 41 and the plug prong (not shown). Top wall 54 is notched as at 59 to provide clearance from threaded tube 36. Finally, extending from opposed ends of wall 54 and in a direction opposite legs 55 are a pair of electrically conductive insulation piercing tangs 51, 61.

Conductor 42 also includes a flat top wall 64 adapted to rest upon the tops of walls 27 when conductor 42 is received such that respective end portions thereof are received within channels 32 and 33. Extending from left and right sides of wall 64 near the bottom end thereof are a pair of opposed L-shaped legs 65, each of which extends generally in the same direction as legs 45 and 55 of conductors 40 and 41, respectively. Each of legs 65 terminates at the mid-section of a leg 66 of a U-shaped female ground lug receiver 67. Legs 66 are joined by a back wall 68 to define the U-shaped female ground lug receiver 67. Legs 66 and legs 65 cooperate to cause legs 66 to be resiliently urged toward each other. Extending from the left and right sides of plate 64 toward the top thereof are a second pair of legs 69 which are substantially similar to legs 66 and define another U-shaped female ground lug receiver. Legs 69 are likewise resiliently urged toward one another. Top wall 64 is provided with a hole 70 through which is received tube 36. When conductor 42 is positioned within housing 14, legs 66 extend into channel 32 so as to receive a ground lug of an electrical plug (not shown) when it is inserted through a slot 23 in front wall 20 so as to make electrical and mechanical connection between conductor 42 and the plug ground (not shown). Similarly, legs 69 will be received in channel 33 so as to receive a male ground lug of an electrical plug (not shown) when it is inserted through the other of slots 23 in front wall 20. Finally, extending from opposed top and bottom ends of flat wall 64 and in a direction opposite legs 65, 66, and 69 are a pair of electrically conductive insulation piercing tangs 52, 62.

As can be seen in FIG. 1, each of tangs 50–52 and 60–62 include a plurality of teeth 75 which are adapted to pierce the sheathing and insulation of a non-metallic sheathed cable and make electrical contact with a respective wire portion thereof as will be explained hereafter. As can also be seen from FIG. 1, tangs 50 and 60 are spaced apart a first distance of approximately 1½", tangs 51 and 61 are spaced apart a second distance of approximately 1", and tangs 52 and 62 are spaced apart a third distance of approximately 1¼". The above spacing is provided in the preferred embodiment in order to allow selected wires of a pair of cables to be coupled together through the electrical plug receptacle apparatus 5 of the present invention as will be described hereafter.

Once conductors 40–42 are received within their respective channels 30–33 of housing 14, backing plate 78 is received thereover to hold the conductors within housing 14. Backing plate 78 is preferably an integral plastic piece comprised of top and bottom blocks 79 and center block 81 joined by webs 80 to define a pair of channels 84 and 85. Webs 80 are provided with a plurality of offset slots 86 through which the teeth 75 of tangs 50–52 and 60–62 are received so that when assembled as in FIG. 1, tangs 50–52 extend into channel 84 and tangs 60–62 extend into channel 85.

To hold backing plate 78 to housing 14, top and bottom blocks 79 are each provided with a tab 87 (only one shown). Each of tabs 87 is matingly and lockingly receivable in mating notches or detents 88 (only one shown) in top and bottom side walls 16 and 18, respectively, of housing 14. Note that side walls 15 and 17 are notched as shown in FIGS. 1 and 2 to form the opposite ends of channels 84, 85 when plate 78 is secured to housing 14.

Threaded tube 36 is offset with respect to the center of at least two opposed walls of housing 14. Preferably, tube 36 is centered with respect to left and right side walls 15 and 17, but off-center with respect to top and bottom walls 16 and 18. Web 80 and center block 81 of backing plate 78 are provided with a similarly offset hole 89 to receive tube 36 therethrough. The offset will become apparent in connection with the subsequent discussion of alignment of clamp 9 to plug body 7.

Figure 3:
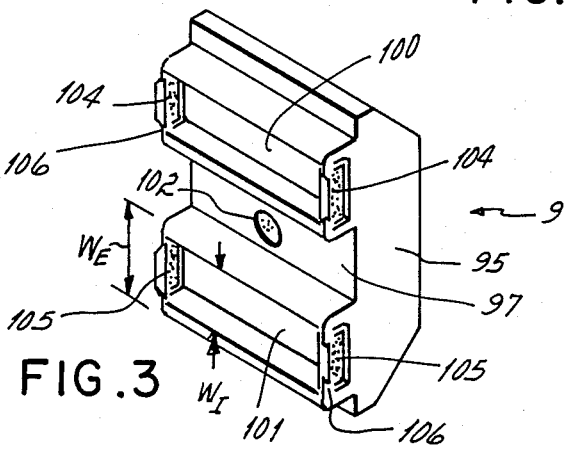
FIG. 3 is a perspective view of the clamp of the electrical plug receptacle apparatus of FIG. 1 shown from the opposite side from that of FIG. 1.

Clamp 9 of electrical plug receptacle apparatus 5 is a trapezoidal plastic block as seen in FIGS. 1 and 3. Clamp 9 has left and right side walls 95, 96 interconnected by a front wall 97. Formed integral front wall 97 are a pair of C-shaped channels 100, 101 which have an exterior width $W_E$ (measured parallel walls 95, 96) approximately equal to or slightly less than the width of channels 84, 85 so that channels 100, 101 of clamp 9 may be received within channels 84, 85, respectively, of plug body 7 when clamp 9 is secured thereto. Front wall 97 of clamp 9 is provided with an offset hole 102 through which is receivable the threaded shank of bolt 10 (see FIG. 1) so as to secure clamp 9 to plug body 7 by threading bolt 10 into tube 36. Due to the offset of hole 102, only when channel 100 is aligned with channel 84 will hole 102 be aligned with tube 36. This prevents application of clamp 9 to plug body 7 with the wrong clamp channel 100 or 101 in housing channel 84 or 85. This can be important when coupling multiple cables to apparatus 5 and/or to make sure that the wires of the cable are coupled to the appropriate conductors within housing 14 for polarization purposes.

Each of clamp channels 100, 101 preferably extends from left wall 95 to side wall 96. Affixed at the ends of the interior of channels 100, 101 are left and right removable end walls 104, 105, respectively. End walls 104, 105 prevent access to channels 100, 101 through their associated left or right side wall 95, 96. As will be appreciated, once clamp 9 is secured to plug body 7, access to any of channels 84, 85, 100, 101 is possible only if an end wall 104 or 105 has been removed. End walls 104, 105 are held to channels 100, 101 by short tabs 106 which may be easily broken to permit removal of an end wall. With one or both of end walls 104, 105 removed, a portion of a sheathed cable 200 may be longitudinally received in the interior of a channel 100 or 101. The interiors of the channels 100, 101 have a width $W_I$ (also measured parallel walls 95, 96) which is approximately equal to the width $W_C$ (see FIGS. 1 and 5) of a sheathed cable 200 so as to snugly hold cable 200 therein and restrain same from transverse movement relative clamp 9.

Figure 5:
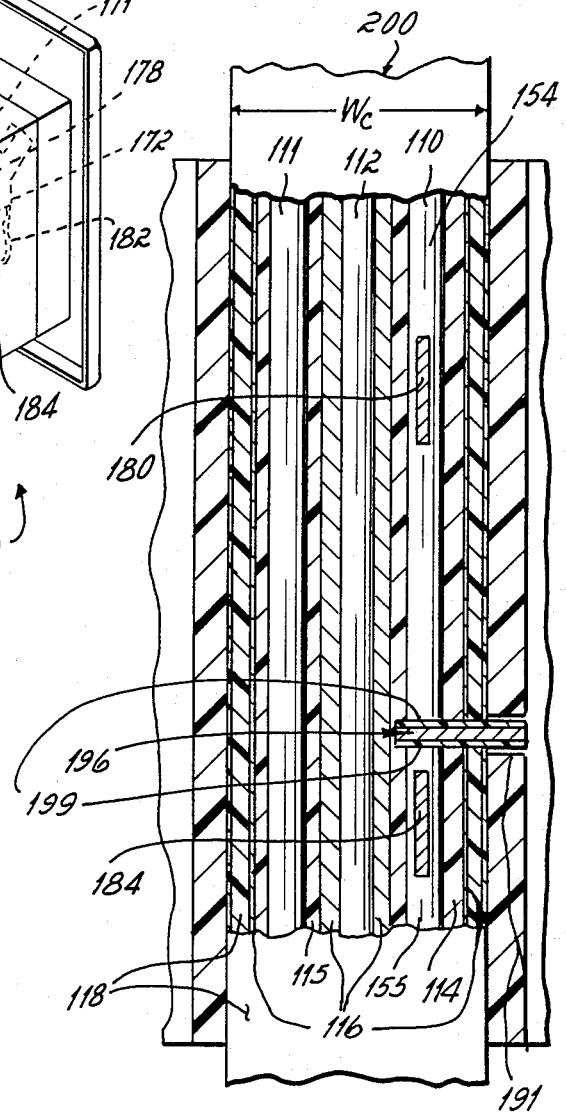
FIG. 5 is a side view of the assembled electrical switch apparatus of FIG. 4 taken along line 5—5 of FIG. 4.

Before proceeding to an explanation of the manner in which the various wires of a sheathed cable 200 are to be coupled to the conductors within housing 14 and/or the various wires of a sheathed cable 200 are to be coupled to the various wires of a second cable 220, reference is had to FIG. 5 showing a sheathed cable 200 in transverse cross-section through the longitudinal axis of each of the wires thereof. It should be appreciated that when applicants refer to cable or sheathed cable herein and in the claims hereafter, applicants are referring to non-metallic sheathed cable in its conventional sense and as now explained.

Sheathed cable 200 conventionally means a cable having at least three wires 110, 111, and 112 which are in side-by-side relationship such that their central axes lie in substantially the same plane. The outer wires 110 and 111 of cable 200 are axially surrounded or encased by non-conductive plastic insulation 114 and 115, respectively. Insulation 114 is generally black to indicate that wire 110 is a hot wire. Similarly, insulation 115 is generally white to indicate that wire 111 is a neutral wire. Disposed between wires 110 and 111 is ground wire 112 which is typically not covered by plastic insulation, although it is usually wrapped in a paper material 116. Paper material 116 is similarly wrapped around the side-by-side arrangement of wires 110–112 and the related insulation, and thereafter all of the wires, their insulation and any paper is contained within a non-conductive plastic sheathing 118. Once in the sheath, the side-by-side relationship of wires 110–112 and the associated insulation, paper and sheathing define the generally flat cable 200 having a width $W_C$ greater than its height $H_C$ (see also FIG. 1).

Returning to FIG. 1, there will now be described the manner in which to couple the various wires 110–112 of cable 200 to the respective contacts 48, 58 and 66 of apparatus 5. If only a terminal portion of a cable 200 is to be so coupled, only one of end walls 104 or 105 from one of the channels 100, 101 is to be removed from clamp 9 so that one end of cable 200 extends from one wall of clamp 9. If an intermediate portion of a cable 200 is to be so coupled, such as a loop thereof, both end walls 104 or 105 of a channel 100 or 101 are to be removed so that the cable extends beyond both walls 95, 96 of clamp 9. Thereafter, either the terminal or loop portion of cable 200 is to be longitudinally fitted in the interior of channel 100, for example, such that the width $W_C$ of the cable portion is co-extensive with the width $W_I$ of the channel and so that the flat side of the cable is generally parallel front wall 97 of clamp 9. Due to the size relationship of $W_I$ and $W_C$, the cable will be constrained against transverse movement relative clamp 9.

If only a terminal portion of a cable is to be used, the terminus thereof is preferably placed close to remaining end wall 104 or 105 of that channel. By various combinations of the foregoing with respect to all four end walls 104, 105, more than one cable portion may be received in clamp 9 wherein each is only a terminal end of a cable, each is only a loop portion of a cable, or one is a loop portion of a cable and the other is a terminal end of a second cable.

Once cable 200 is situated in channel 100, clamp 9 is situated over plug body 7 such that channel 100 is within channel 84 and hole 102 is aligned to tube 36. Note that tangs 60–62 (and tangs 50–52) are in offset relationship such that when a cable-laden clamp 9 is properly positioned on plug body 7, each of wires 110–112 will be in overlying relationship to a respective tang 60–62 (or tangs 50–52, if the cable is in channels 101 and 85).

Slots 21 are generally shorter (between top and bottom walls 16 and 18) than slots 22 of front wall 20 so as to accommodate polarized plugs (not shown) wherein the narrower power prong is to be coupled only to the hot wire of the cable. Thus, it is desired to couple contacts 48 (behind slots 21) to hot wire 110 of cable 200 rather than neutral wire 111 thereof. To this end, it is necessary to insure that cable 200 (and/or cable 220) is positioned relative tangs 50–52 or 60–62 such that wire 110 will be placed in overlying relationship with insulation piercing tangs 50 or 60 (depending upon which channel is employed) and not with any of the other of tangs 51, 52, 61, or 62. To this end, cable 200 (and/or 220) may be provided with indicia (not shown) showing that the cable should be received in one of channels 100 or 101 so that wire 110 is positioned further from hole 102 than either of wires 111 or 112. When properly positioned, wire 110 will be in overlying relationship with either of tangs 50 or 60, wire 111 will be in overlying relationship with either of tangs 51 or 61, and wire 111 will be in overlying relationship with either of tangs 52 or 62.

After cable 200 is appropriately positioned by clamp 9, bolt 10 is to be threadably received in tube 36. Bolt 10 and washer 11 cooperate to drive clamp 9 in a direction toward front wall 20 of housing 14 to thereby effect relative movement between cable 200 and teeth 75 whereby to drive cable 200 toward and into tangs 60–62. As a consequence, (1) each of tangs 60–62 will pierce sheathing 118, (2) tangs 60 and 61 will pierce insulation 114 and 115 between tangs 60 and 61 and wires 110 and 111, respectively, and any paper therebetween, and (3) tang 62 will pierce any paper between it and wire 112, whereafter tangs 60–62 will be brought into electrical contact with wires 110–112, respectively, of cable 200.

In the foregoing manner, wires of a cable 200 are brought into electrical communication with respective conductors of an electrical plug receptacle apparatus 5 so that when the male prongs of a plug (not shown) are received through the slots 20–22 in front wall 20 and into electrical and mechanical interconnection with the appropriate contacts of the conductors therebehind, electrical communication will be established between the plug (not shown) and any apparatus electrically coupled thereto (not shown) and the wires of cable 200.

If it is desired to couple the wires of another cable 220 to the wires of cable 200, cables 200 and 220 are to be positioned in channels 100, 101, respectively, as before described in connection with cable 200. Thereafter, placing of clamp 9 on plug body 7 will similarly and simultaneously position wires 110–112 of cable 220 over tangs 50–52 to be electrically coupled thereto as described in connection with cable 200, such that wires 110 of two cables 200, 220 will be electrically coupled to the plug receptacle contacts 48 and to each other. Similarly, wires 111 of the two cables will be electrically coupled to each other and their appropriate plug contact 58. Also, wires 112 of the two cables will be electrically coupled to each other and to ground lug receivers of conductor 42. Thus, electrical plug receptacle apparatus 5 may be coupled to the wires of a sheathed cable and/or respective wires of one sheathed cable can be coupled to respective wires of another sheathed cable, all without cutting a cable, without removing sheathing from a cable, and without removing any insulation from any of the wires of the cables. Thus, a user or electrician need merely position the cable in a channel 100 or 101 of clamp 9, position clamp 9 appropriately with respect to housing 14, and tighten bolt 10 so that clamp 9 is driven toward intimate contact with housing 14 whereby the insulation piercing tangs will pierce the sheathing, insulation and paper to make electrical contact with the wires of the cable. This will eliminate much of the time-consuming and costly labor associated with connecting the sheathed cable to the plug receptacle apparatus of the prior art. Such construction also eliminates the necessity to expose the ends of wires so that they may be joined together by wire nuts or the like and, thus, eliminate both the labor and materials cost associated therewith.

To secure electrical plug receptacle apparatus 5 to its desired location on the wall 120 of a building structure or the like (not shown), housing 14 is provided with structure adapted to secure apparatus 5 directly to wall 120 or a like structure. This securing structure preferably includes a stationary tab 122 extending from each of top and bottom walls 16, 18 and perpendicular thereto, and a parallel, pivoting tab 124 similarly extending therefrom. Thus as seen in FIGS. 1 and 2, tabs 122 and 124 are cantilevered from housing 14. Tab 122 is generally in the same plane as front wall 20 of housing 14, whereas tab 124 is spaced therebehind approximately ½" to provide a space into which an edge of a wall may be received. Front tab 122 is provided with a slot 126 through which is receivable a screw 127 or the like. Screw 127 is further receivable in a threaded hole 128 in tab 124. Tabs 124 are preferably joined to respective walls 16 and 18 by thin strip portions 129, whereat tab 124 may pivot from its perpendicular position shown in FIG. 1 as screw 127 is threadably received in threaded hole 128.

To secure apparatus 5 to wall 120 after coupling cable 200 and/or cable 220 to apparatus 5, the apparatus is receivable through a slot 135 formed in wall 120 by tilting apparatus 5 at an angle of approximately 45°, such that top wall 16 is positioned near one corner 136 of slot 135 and bottom wall 18 is positioned near the opposite, confronting corner of slot 135 whereupon apparatus 5 may be inserted through slot 135 from a position exteriorly of wall 135 until tabs 124 pass therethrough to be positioned interiorly of wall 120. Thereafter, apparatus 5 is to be rotated to a 0° position as shown in FIG. 1 such that portions of wall 120 are situated between front tabs 122 and pivot tabs 124. Thereafter, screws 127 are employed to cause pivot tabs 124 to angle toward front tab 122 whereby to grippingly engage interior and exterior portions of wall 120 therebetween, thus securing apparatus 5 to wall 120. Pivot tabs 124 are preferably provided with ribbed sections 132 along their upper peripheries so as to better engage the interior of wall 120. Once apparatus 5 is secured to wall 120, plate 25 may be received over front wall 20 and screw 24 utilized to secure plate 25 to apparatus 5 in conventional fashion.

Alternatively, screw 127 may be used to secure apparatus 5 to a conventional junction box (not shown) by removing tabs 124 from housing 14 such as by breaking them off along thin strip portions 129.

Thus, there is provided structure by which apparatus 5 may be selectively secured directly to a structural wall or to a junction box wherein the apparatus may be used for both new and existing building structures. In particular, if apparatus 5 is to be used on an existing wall, the hole in which apparatus 5 is to be placed need only be sized to accommodate the housing thereof, thus avoiding unsightly or expensive-to-repair oversize holes in the wall.

Once cables 200 and/or 220 are secured to apparatus 5, remaining end walls 104, 105 and/or the lack of any exposed slices or cuts in the cables result in there being no electrical wire or junction exposed. Thus, it is possible to eliminate entirely the junction box (not shown) and save the labor and material costs associated therewith.

Figure 4:
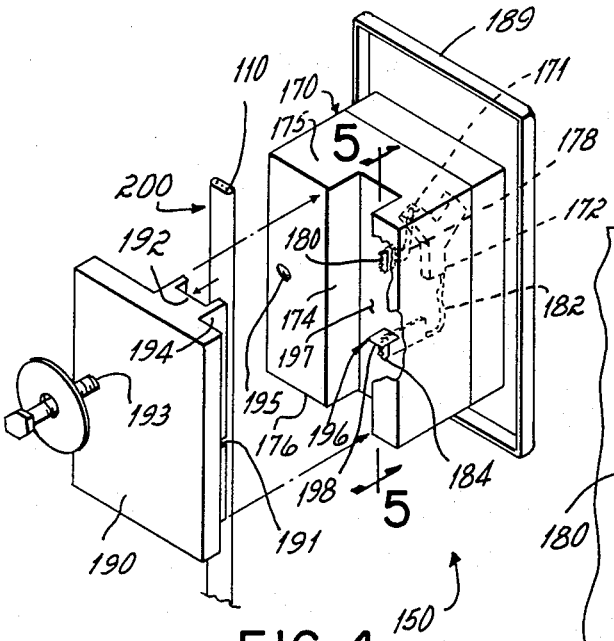
FIG. 4 is a perspective, partially cut-away, and partially exploded view of an electrical switch apparatus according to the principles of the present invention.
Figure 6:
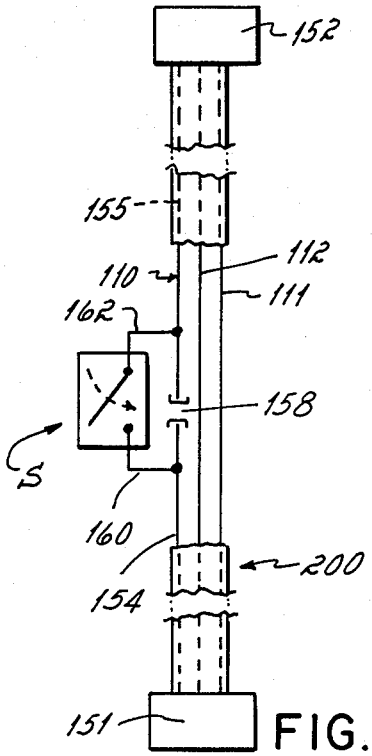
FIG. 6 is a schematic representation of the electrical switch apparatus of FIG. 4 in a completed circuit arrangement.

Reference will now be had to FIGS. 4 through 6 to explain the preferred electrical switch apparatus 150 of the present invention. With reference to FIG. 6, it is understood that wires 110–112 of a cable 200 may be coupled at one end to a power source 151, such as a breaker box, and at the other end to a utilization device 152 which may be any electrical apparatus including a drill, a toaster, a word processing machine, a lamp or other light socket, or even an electrical plug receptacle apparatus 5 of the present invention. Wires 111 and 112 are connected between power source 151 and utilization device 152 without electrical interruption. To provide the switch function and thereby control the on/off status of a utilization device 152, wire 110 is severed into two electrically separate wire portions 154, 155 as indicated by the break 158 in FIG. 6. Wire portion 154 of wire 110 is coupled to power source 151 whereas second wire portion 155 of wire 110 is coupled to utilization device 152. As is well known, in order to provide a switching function, poles 160 and 162 of a switch S may be coupled to respective portions 154 and 156 of wire 110 such that when switch S is in the open position as shown in FIG. 6, utilization device 152 will be disconnected from power source 151 due to the break in wire 110 at 158. Similarly, to couple utilization device 152 to the power source 151, switch S may be closed as shown by the dotted arrow in FIG. 6 to thereby electrically couple poles 160 and 162, thus bringing wire portions 154 and 155 of wire 110 into electrical communication. Previously, break 158 was accomplished by cutting and stripping the sheathing and insulation of cable 200. Applicants eliminate these steps and overcome the related drawbacks by providing the structure as shown in FIG. 4.

Specifically, switch apparatus 150 as shown in FIG. 4 comprises a housing having a switch body 170, in which is contained a switch and its associated poles 171, 172 as indicated schematically in dotted line in FIG. 4 and a clamp 190. Formed in the back of switch body 170 is a channel 174 which extends between top wall 175 and bottom wall 176 of switch body 170. Within switch body 170 is provided a first conductor 178 which is connected to pole 171 and also connected to an electrically conductive insulation piercing tang 180 (with a plurality of teeth 75). Tang 180 extends into channel 174. Similarly, a second conductor 182 is connected to pole 172 and also connected to a second electrically conducting insulation piercing tang 184 (with a plurality of teeth 75) which similarly extends into channel 174. As seen in FIG. 5, tangs 180 and 184 are aligned within channel 174 so that when a cable 200 is placed therein as will be described, wire 110 is in overlying relationship with both of tangs 180 and 184, whereas wires 111 and 112 are not so positioned.

Clamp 190 includes a C-shaped channel 192 similar to either of channels 100 or 101 of clamp 9. Thus, channel 192 has an interior width approximately equal to the width of cable 200 to longitudinally receive cable 200 therein and hold it against transverse movement relative clamp 190. Similarly, the outer perimeter 194 of channel 192 is sized to fit within channel 174.

To couple cable 200 to switch device 150, cable 200 is placed within channel 192 and clamp 190 is mated with switch body 170. Clamp 190 and switch body 170 include holes 193, 195 (the latter being threaded) to receive therethrough and therein bolt 10 so that as bolt 10 is threaded into hole 195, clamp 190 will be driven toward switch body 170 whereby cable 200 is driven into teeth 75 of tangs 180 and 184. As a consequence, tangs 180 and 184 pierce sheath 118, insulation 114 and any paper therebetween, and come into electrical contact with respective portions of wire 110.

To provide break 158 necessary for wire 110, there is provided a blade 196 in channel 174 extending from the bottom 197 thereof to a position higher than the uppermost extremities of teeth 75 of tangs 180 and 184. Thus, cable 200 will preferably contact a knife edge 198 of blade 196 before cable 200 contacts tangs 180 and 184. As cable 200 is moved toward tangs 180 and 184, blade 196 will cut into the edge of sheath 118 adjacent wire 110, through insulation 114 of wire 110, and completely through wire 110 to splice same into upper and lower portions 154 and 155 as seen in FIG. 5. Channel 192 is provided with a slot 191 in the perimeter 194 to accomodate blade 196 as it passes into channel 192. Thus, tang 180 will be connected to portion 154 of wire 110 and tang 184 will be connected to portion 155 of wire 110 so that switch poles 170, 171 are coupled to respective wire portions 154, 155 of wire 110 to provide the switching function S as shown schematically in FIG. 6.

Blade 196 is typically metal. To prevent blade 196 from electrically shorting wire portion 154 to wire portion 155 thereby defeating the switch function, blade 196 is preferably coated with a non-conductive plastic material 199 between knife edge 198 of blade 196 and bottom 197 of channel 174. This electrically insulates wire portions 154, 155 from one another thereby providing break 158 as seen in FIG. 6. Note that blade 196 is only wide enough to extend partially into channel 174 from one side thereof so that it will not contact or cut sheathing, insulation or any wire except that associated with wire 110.

Although not shown in FIG. 4, switch body 170 is preferably provided with tabs 122, 124 as are provided in connection with the electrical plug receptacle apparatus 5 of the present invention whereby to couple switch apparatus 150 to a wall 120 in a like manner as is done in connection with apparatus 5. Once electric switch apparatus 150 is secured to wall 120, a switch cover 189 may be secured to the front of switch body 170 by a pair of screws (not shown) as is conventional.

With the foregoing electrical plug receptacle apparatus 5 and/or electrical switch apparatus 150 of the present invention, respective wire portions of a sheathed cable may be coupled to their respective plug contacts and/or switch poles without the necessity to cut the cable, remove sheathing from the cable, and/or remove insulation from the respective wires, thus saving considerable time and, therefore, considerable labor costs normally associated with wiring plug receptacles and/or switches to conventional sheathed cable. Additionally, with the apparatus according to the present invention, it is possible to electrically couple together selected wires of one cable with selected wires of another cable, while at the same time providing the electrical interconnection to the plug contacts and/or switch poles thereby further saving the labor costs, and additionally saving materials costs associated with apparatus conventionally employed to join together the selected wires such as wire nuts. Yet further, the present invention allows for elimination of the junction box thus further adding to the savings in time and material.

The plastic housings of plug receptacle apparatus 5 and switch apparatus 150 are preferably made of DuPont-polyamid nylon-type 66 plastic or an equivalent plastic which is U.L. listed and meets U.L. flame class 94V-2. Electrical conductors within the apparatus are preferably 0.030 beryllium copper-solution annealed and heat treated at 600° F. for three hours.

While the present invention has been described with specific reference to plug receptacles and/or electrical switches, it will be appreciated by those of ordinary skill in the art that its application is more general and is applicable in connection with many types of electrical apparatus which are to be coupled to sheathed cable as referred to herein. Thus, additional advantages and modifications will readily occur to those skilled in the art. The invention in its broader aspects is therefore not limited to the specific details, representative apparatus, and illustrative examples shown and described. Accordingly, departures may be made from such details without departing from the spirit or scope of applicants' general inventive concept.

Having described the invention, what is claimed is:

1. In combination:

a non-metallic sheathed cable having at least three elongated parallel wires extending between opposite ends of said cable; an uninterrupted band of insulating skin surrounding said wires and defining a width of said cable measured perpendicular said wires; and insulator means interiorly of said skin electrically isolating said wires from one another within said skin; and electrical apparatus including:

a housing having a body and a clamp attached to said body;

three laterally spaced conductive tangs in said body and connected to electrical elements within said body;

a cable-receiving channel having a width about equal to said cable width, said cable being received within said cable-receiving channel and maintained in a position overlying said tangs with each said tang aligned with a respective wire of said cable, said cable being disposed between said body and said clamp; and means for tightening said clamp against said cable to force said tangs through said skin and any intervening said insulator means and into contact with said respective wires of said cable;

such that upon tightening said clamp against said cable, said respective wires of said cable will be electrically coupled to said electrical elements, without first cutting said skin between said cable ends to expose said wires and insulator means prior to said cable being received in said cable-receiving channel.

2. In combination:

a non-metallic sheathed cable having at least three elongated parallel wires extending between opposite ends of said cable; an uninterrupted band of insulating skin surrounding said wires and defining a width of said cable measured perpendicular said wires; and insulator means interiorly of said skin electrically isolating said wires from one another within said skin; and electrical apparatus including:

a housing having a body and a clamp attached to said body;

two laterally aligned tangs in said body and connected to respective poles of a switch within said body;

cutting means situated between said tangs for severing said skin, one of said wires and any said insulator means therebetween;

a cable-receiving channel having a width about equal to said cable width, said cable being received within said cable-receiving channel and maintained in a position overlying said tangs and cutting means with each tang aligned with a respective portion of said one wire of said cable and said cutting means aligned with said one wire at a junction of said respective wire portions, said cable being disposed between said body and said clamp; and means for tightening said clamp against said cable to force said tangs and cutting means through said skin and any intervening said insulator means and bringing said tangs into electrical contact with the respective portions of said one wire of said cable;

such that upon tightening of said clamp against said cable, said respective portions of said one wire will be electrically isolated from one another and coupled to said respective switch poles, without first cutting said skin between said cable ends to expose said wires and insulator means prior to said cable being received in said cable-receiving channel.

3. Apparatus comprising:

a non-conductive housing enclosing an electrical apparatus;

means associated with said housing for coupling wires of a cable to said electrical apparatus;

each end of said housing having an integral cantilevered interior tab and an integral cantilevered exterior tab spaced from said interior tab to receive an edge of a wall panel therebetween; and means for tightening said tabs against said wall panel.

4. The electrical apparatus of claim 3, said interior tab being connected to said housing by a flexible strip.

5. The electrical apparatus of claim 3, said tightening means being a screw housing through said exterior tab and threaded into said interior tab.

6. In an electrical plug receptacle or electrical switch apparatus adapted to be positioned along a structural wall wherein the apparatus has a housing which is to be fitted through a hole in the structural wall, such that a front of the housing is substantially coplanar with an exterior surface of the structural wall and a portion of the housing is behind an interior surface of the structural wall, means for selectively coupling the apparatus directly to the structural wall or a junction box within the structural wall, said means comprising:

a first tab extending in a first direction from the apparatus housing and substantially coplanar with the front of the apparatus housing;

a second, movable tab extending from the apparatus housing in substantially said first direction, said second tab being spaced rearwardly of said first tab to define a structural wall-receiving space therebetween; and means extending from said first tab for selectively (1) engaging said second tab and moving said second tab toward said first tab whereby to narrow said structural wall receiving space so that when a structural wall is received in said space said tabs will grip the interior and exterior surfaces of the structural wall, and (2) engaging the junction box within the structural wall and moving said first tab toward the junction box whereby to secure the apparatus directly to the structural wall, said means normally engaging said second tab, said second tab being removable wherein said means will engage the junction box.

7. In the apparatus of claim 6, said second tab having an edge joined integrally to said housing by a flexible strip whereby as said means moves said second tab, said second tab will pivot about an axis defined along said strip, said second tab being removable from the apparatus housing by breaking it off along said strip.

8. In combination:

a wall panel having an opening;

electrical apparatus comprising:

a housing;

electrical elements within said housing;

means associated with said housing for coupling wires of a cable to said electrical elements;

each end of said housing having an interior tab and an exterior tab spaced from said interior tab to receive an edge of said wall panel therebetween; and means for tightening said tabs against said wall panel;

whereby said electrical apparatus is mounted to said wall panel by inserting said housing through said opening such that said housing ends lie along an angled line between confronting corners of said panel opening until said interior tabs pass into said opening, thereafter twisting said housing until said housing ends lie along a generally vertical line, and thereafter tightening said tabs against said wall panel.

9. In combination:

a non-metallic sheathed cable having at least three elongated parallel wires extending between opposite ends of said cable; and uninterrupted band of insulating skin surrounding said wires and defining a width of said cable measured perpendicular said wires; and insulator means interiorly of said skin electrically isolating said wires from one another within said skin; and electrical apparatus adapted to be electrically coupled to said cable, including;

a housing;

first and second conductive tangs associated with said housing and connected to respective electrical elements within said housing;

a cable-receiving channel having a width about equal to said cable width, said cable being received within said cable-receiving channel and maintained in a position overlying said tangs with said first and second tangs aligned with respective first and second wire portions of said cable; and means for tightening said cable against said tangs to force said tangs through said skin and any intervening said insulator means and into electrical contact with said respective wire portions;

such that upon tightening said cable against said tangs, said respective wire portions will be electrically coupled to said electrical elements, without first cutting said skin between said cable ends to expose said wires and insulator means prior to said cable being received in said cable-receiving channel.

10. The combination of claim 9, wherein said first and second wire portions are part of a first said wire and a second, different said wire, respectively, said tangs being laterally offset from one another such that each is aligned with a respective one of said first and second wires whereby as said cable is tightened against said tangs, said first and second tangs come into electrical contact with said first and second wires, respectively.

11. The combination of claim 9, said housing including a side wall and said channel means having one end adjacent said side wall, said electrical apparatus further including:

a selectively removable end wall associated with said channel means one end whereby a truncated portion of said cable adjacent one end thereof is received in said cable-receiving channel after removal of said end wall.

12. The combination of claim 9, said housing including opposite side walls and said channel means having opposite ends adjacent a respective said side wall of said housing, said electrical apparatus further including:

selectively removable end walls associated with each said end of said channel means whereby a truncated portion of said cable adjacent one end thereof is received in said cable-receiving channel after removal of one said end wall, and a portion of said cable intermediate said ends is received in said cable-receiving channel after removal of both said end walls.

13. The combination of claim 9, said electrical apparatus further including:

clamp means movable relative said housing for movably carrying said cable-receiving channel.

14. The combination of claim 13, said means for tightening including:

bolt means having a shank threadably receivable in said housing and slidably receivable through a hole in said clamp means and having a head larger than said clamp means hole for moving said clamp means toward said housing as said bolt means shank is threadably received in said housings, whereby to tighten said cable against said tangs.

15. The combination of claim 13, said electrical apparatus further including:

a second channel defined in said housing and into which said tangs project, said second channel dimensioned to receive therein a portion of said clamp means including said cable-receiving channel whereby said cable is maintained in overlying relationship with said tangs.

16. The combination of claim 13, said electrical apparatus further including:

alignment means for positioning said clamp means in operative relationship to said housing whereby to situate said cable-receiving channel relative said tangs such that respective said wire portions are in overlying relationship to respective said tangs.

17. The combination of claim 9, wherein said respective wire portions are part of one said wire, said tangs being positioned in a line such that each is aligned with said respective portion of said one wire, said electrical apparatus further including:

cutting means positioned intermediate said tangs for bisecting said skin, said one wire, and any intervening portion of said insulator means as said cable is tightened against said tangs, whereby to electrically isolate said respective wire portions from one another within said cable.

18. The combination of claim 17, said electrical apparatus further including:

switch means coupled to said electrical elements for selectively electrically connecting said tangs whereby to selectively electrically couple said first wire portion to said second wire portion.

19. The combination of claim 17, said cutting means comprising:

a blade projecting from said housing and terminating in a cutting edge spaced above said tangs, and non-conductive means extending between said housing and said cutting edge whereby said first and second wire portions positioned to either side of said cutting means will not be electrically coupled via said cutting means after said cable is completely tightened against said tangs.

20. The combination of claim 9, said electrical apparatus further including:

wall gripping means adapted to grip interior and exterior surfaces of a structural wall whereby to secure said electrical apparatus directly to the structural wall.

21. The combination of claim 20, said wall gripping means including:

a first tab extending from said housing in a first direction;

a second, movable tab extending from said housing in substantially said first direction, said second tab being spaced from said first tab to define a structural wall-receiving space therebetween; and means for bringing said second, movable tab toward said first tab whereby to narrow said structural wall-receiving spaces so that when a structural wall is received in said space said tabs will grip the interior and exterior surfaces of the structural wall.

22. The combination of claim 21, said tabs each being integral a portion of an exterior surface of said housing.

23. In combination:

a non-metallic sheathed cable having at least three elongated parallel wires extending between opposite ends of said cable; an uninterrupted band of insulating skin surrounding said wires and defining a width of said cable measured perpendicular said wires; and insulator means interiorly of said skin electrically isolating said wires from one another within said skin; and electrical apparatus adapted to be electrically coupled to said cable, including:

a housing:

first, second, and third conductive tangs associated with said housing and connected to respective electrical elements within said housing;

a cable-receiving channel having a width about equal to said cable width, said cable being received within said cable-receiving channel and maintained in a position overlying said tangs with said first, second and third tangs aligned with respective first, second and third said wires of said cable; and means for tightening said cable against said tangs to force said tangs through said skin and any intervening said insulator means and into electrical contact with said respective wires;

such that upon tightening said cable against said tangs, said respective wires will be electrically coupled to said electrical elements, without first cutting said skin between said cable ends to expose said wires and insulator means prior to said cable being received in said cable-receiving channel.

24. The combination of claim 23, said electrical apparatus further including:

clamp means movable relative said housing for movably carrying said cable-receiving channel.

25. The combination of claim 24, said means for tightening including:

bolt means having a shank threadably receivable in said housing and slidably receivable through a hole in said clamp means and having a head larger than said clamp means hole for moving said clamp means toward said housing as said bolt means shank is threadably received in said housing, whereby to tighten said cable against said tangs.

26. The combination of claim 24, said electrical apparatus further including:

a second channel defined in said housing and into which said tangs project, said second channel dimensioned to receive therein a portion of said clamp means including said cable-receiving channel whereby said cable is maintained in overlying relationship with said tangs.

27. The combination of claim 24, said electrical apparatus further including:

alignment means for positioning said clamp means in operative relationship to said housing whereby to situate said cable-receiving channel relative said tangs such that respective said wire portions are in overlying relationship to respective said tangs.

28. In combination:

first and second non-metallic sheathed cables, each said cable having at least three elongated parallel wires extending between opposite ends of said cable; and uninterrupted band of insulating skin surrounding said wires and defining a width of said cable measured perpendicular said wires; and insulator means interiorly of said skin electrically isolating said wires from one another within said skin; and electrical apparatus adapted to electrically couple said cables together, including:

a housing;

three pairs of conductive tangs associated with said housing, each said pair of tangs connected to respective electrical elements within said housing whereby first and second tangs of a said pair of tangs are electrically coupled to one another;

a pair of cable-receiving channels each having a width about equal to a respective said cable, a first said cable being received within a first said cable-receiving channel and maintained in a position overlying said first tangs with respective said first tangs aligned with respective wires of said first cable, a second said cable being received within a second said cable-receiving channel and maintained in a position overlying said second tangs with respective said second tangs aligned with respective wires of said second cable; and means for tightening said cables against said tangs to force said tangs through said skin and any intervening said insulator means and into electrical contact with said respective wires;

such that upon tightening said cables against said tangs, said respective wires of said cables will be electrically coupled to one another, without first cutting either said skins between said cable ends to expose said wires and insulator means prior to placement of said cables in said cable-receiving channels.

29. The combination of claim 28, said electrical apparatus further including:

clamp means movable relative said housing for movably carrying said cable-receiving channels.

30. The combination of claim 29, said electrical apparatus further including:

second and third channels defined in said housing and into which said first and second tangs, respectively, project, said second and third channels dimensioned to receive therein portions of said clamp means including a respective said cable-receiving channel whereby said cables are maintained in overlying relationship with said tangs.

31. A method of mounting an electrical apparatus to a wall panel having an opening, the electrical apparatus having a housing, each end of the housing having an interior tab and an exterior tab spaced from the interior tab to receive an edge of the wall panel therebetween, and means for tightening the tabs against the wall panel, the method comprising:

inserting the housing through the opening such that the housing ends lie along an angled line between confronting corners of the panel opening until the interior tabs pass into the opening;

thereafter twisting the housing until the housing ends lie along a generally vertical line; and thereafter tightening the tabs against the wall panel.

32. Apparatus to connect electrical elements to a non-metallic sheathed cable having at least three elongated parallel wires extending between opposite ends of said cable, an uninterrupted band of insulating sheath surrounding said wires and defining a width of said cable measured perpendicular said wires, and insulator means interiorly of said sheath electrically isolating said wires from one another within said sheath, the apparatus comprising:

a housing having a body and a clamp attached to said body;

at least two conductive tangs in said body and connected to electrical elements within said body, each said tang having a terminal end including a row of teeth adapted to pierce the cable sheath and insulator means;

means for maintaining the cable in a position overlying said tangs with each said row of teeth axially aligned with a respective wire portion of the cable, the cable being disposed between said body and said clamp; and means for tightening said clamp against said cable to force said teeth through the sheath and insulator means and into contact with the respective wire portions of the cable, whereby to electrically couple the respective wire portions of the cable to said electrical elements within said body.

33. The apparatus of claim 32, said tangs being positioned in said body such that said rows of teeth are laterally aligned whereby to align said tangs with one wire of the cable.

34. The apparatus of claim 32, said tangs being positioned in said body such that said rows of teeth are laterally offset whereby to align said tangs with different wires of the cable.

* * * * *